US007240450B2

(12) United States Patent
Shober

(10) Patent No.: US 7,240,450 B2
(45) Date of Patent: Jul. 10, 2007

(54) HANDGUN DISASSEMBLY DEVICE

(76) Inventor: David R. Shober, 2563 Blossom La., New Castle, PA (US) 16105

( * ) Notice: Subject to any disclaimer, the term of this patent is extended or adjusted under 35 U.S.C. 154(b) by 169 days.

(21) Appl. No.: 11/211,225

(22) Filed: Aug. 25, 2005

(65) Prior Publication Data

US 2006/0053674 A1 Mar. 16, 2006

Related U.S. Application Data

(60) Provisional application No. 60/609,492, filed on Sep. 13, 2004.

(51) Int. Cl.
*F41C 27/00* (2006.01)

(52) U.S. Cl. ..... 42/108

(58) Field of Classification Search ..... 42/108, 42/107, 106

See application file for complete search history.

(56) References Cited

U.S. PATENT DOCUMENTS 4,901,411 A * 2/1990 Chestnut et al. ..... 42/108
6,230,430 B1 * 5/2001 Gosselin ..... 42/90

OTHER PUBLICATIONS http://www.bedair.org/Rohr/Rohrbaugh.html.*

* cited by examiner

*Primary Examiner*—Michael J. Carone
*Assistant Examiner*—Gabriel J. Klein
(74) *Attorney, Agent, or Firm*—James R. Williams

(57) ABSTRACT

The present invention relates to a device for placing a slide of a handgun in proper position relative to the barrel so that an otherwise concealed barrel pin is now revealed. The invention is particularly suited for handgun designs otherwise lacking a positive stop, external barrel pins or levers. The device includes an indentation for receiving a front face of the handgun. The indentation is at least partially surrounded by a raised ridge adapted to prevent the slide from entering the indentation. Placing the barrel in the indentation forces the slide backwards from the front face. The elevation difference between the depth of the indentation and the ridge is selected to expose a barrel pin of the handgun.

13 Claims, 3 Drawing Sheets

HANDGUN DISASSEMBLY DEVICE

The present application claims priority to U.S. No. 60/609,492, filed 13 Sep. 2004.

FIELD OF THE INVENTION

The present invention is directed to a device for disassembling and reassembling a handgun and, more particularly, to removal and installation of a barrel pin of a handgun.

BACKGROUND

The trend in firearm production, and in particular the production of handguns, has moved towards fewer moving parts. Benefits of fewer moving parts include improved reliability, reduced cost of manufacture, simplified assembly, disassembly and maintenance, and less chance of part failure.

In addition to improved reliability and efficacy, the use of fewer moving parts can produce a light, compact firearm having improved ergonomics. Such firearms include handguns for self-defense purposes that are more easily concealable. For example, U.S. Pat. No. 6,070,512 to Rohrbaugh describes a handgun having a lightweight, compact, ergonomic construction.

A handgun, such as one of the Rohrbaugh design, has a smooth outer surface and few surface protrusions. Such a handgun can be withdrawn from a concealed holster or position without catching on clothing or apparel. In contrast, handguns of a traditional design include external levers or other protrusions that may impair removal from a concealed position. Such levers and protrusions are often related to disassembly or maintenance of the handgun.

Despite the advantages of handgun designs having smooth outer surfaces, routine maintenance of such handguns, including their assembly and disassembly, can be difficult. For example, the slide and barrel assembly of the Rohrbaugh handgun can be removed from the frame only by holding the slide in a partially retracted position while a barrel pin is removed from the handgun. Unless the slide is held precisely, the barrel pin is not accessible and the slide and barrel assembly cannot be removed. Performance of this procedure requires a degree of dexterity and patience.

An object of the invention is to provide a device that positively places the slide relative to the barrel and frame so that the barrel pin is revealed. Another object of the invention is to facilitate removal and installation of the barrel pin.

BRIEF DESCRIPTION OF THE INVENTION

The present invention relates to a device for placing a slide of a handgun in proper position relative to the barrel and frame so that an otherwise concealed barrel pin is now revealed. Preferably, the position permits the barrel pin to be removed or inserted in a tension-free state. The invention is particularly suited for handgun designs otherwise lacking a positive slide stop, such as external barrel pins or latches.

The invention includes a device adapted to expose a concealed barrel pin of a handgun having a barrel and a slide. The device includes an indentation for receiving a front face of the handgun. The indentation is at least partially surrounded by raised ridge adapted to catch the body of the handgun. An operator pushes the front face into the indentation, such as by using the handgrip, until the front face is flush with the bottom of the indentation and the body is flush with the ridge. The elevation difference between the indentation and the ridge is selected to fix the slide relative to the barrel and frame, thereby exposing a barrel pin of the handgun.

The device may include a second indentation adapted to receive a second front face of the handgun. The depth of the second indentation is selected to compliment the elevation difference of the first indentation and first ridge. The second indentation is at least partially surrounded by a second ridge for receiving a frame of the handgun. The second ridge steadies the handgun, thereby facilitating installation and removal of the barrel pin.

In one embodiment, the device includes an indention for receiving a front face of the barrel. The device also includes a ridge that prevents the frame of the handgun from entering the indentation. The elevation difference between the bottom of the indentation and the ridge is selected to be the distance the slide on the handgun must be retracted to expose the barrel pin. Pushing the handgun into the device forces the slide rearward and exposes the barrel pin, which may be removed or inserted without undue effort.

The device may be used on combination with a barrel pin removal tool. The pin removal tool includes a protrusion having a diameter sufficiently small to fit through a drift hole in the slide. The drift hole aligns with the barrel pin when the handgun is properly positioned in the device. A portion of the pin removal tool may be inserted through the drift hole, thereby pushing the barrel pin through from the slide. Conveniently, the pin removal tool is shaped for easy manipulation by a human hand.

DETAILED DESCRIPTION OF THE INVENTION

Figure 1:
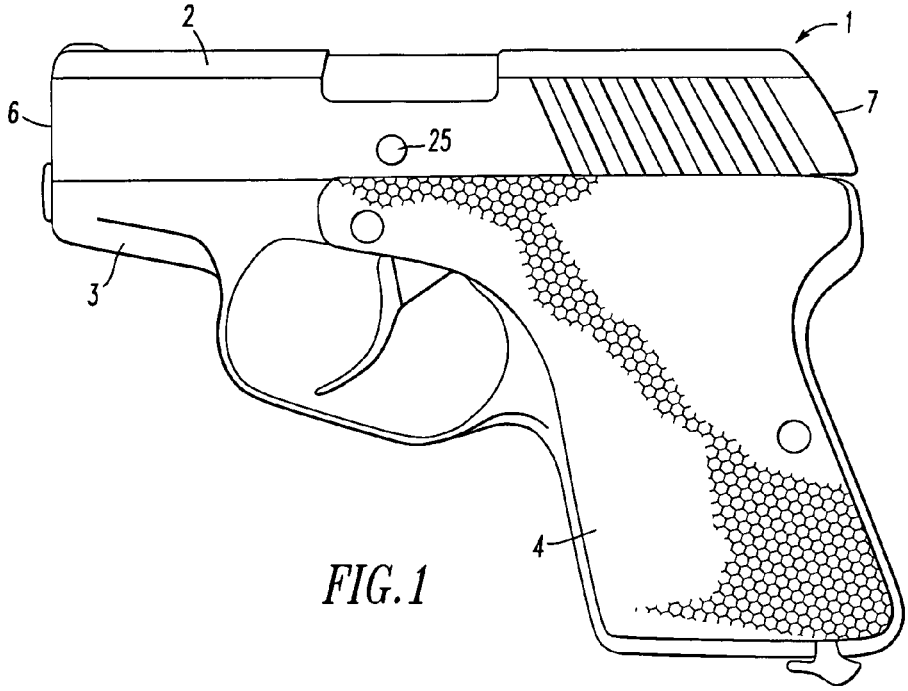
FIG. 1 is obverse side view of a handgun of the Rohrbaugh design.
Figure 2:
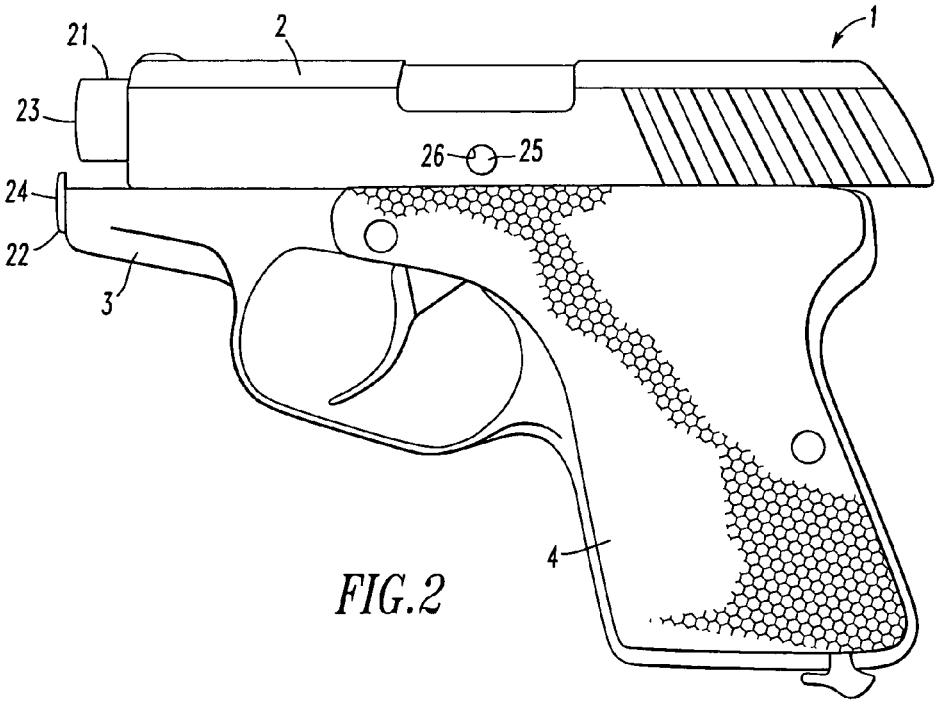
FIG. 2 is obverse side view of a handgun of the Rohrbaugh design with the slide pulled back.

FIG. 1 shows an obverse side of a handgun of the Rohrbaugh design. The handgun 1 includes a slide 2, a frame 3, and a grip 4, a front end 6 and a rear end 7. The slide 2 is adapted to move rearward past the frame 3, as shown in FIG. 2. Disassembly of the handgun requires removal of the slide 2 from the handgun 1 by moving the slide rearward and extracting a barrel pin (not shown). The barrel pin normally restricts disassembly by securing the slide 2 and barrel assembly to the frame 3.

Figure 3:
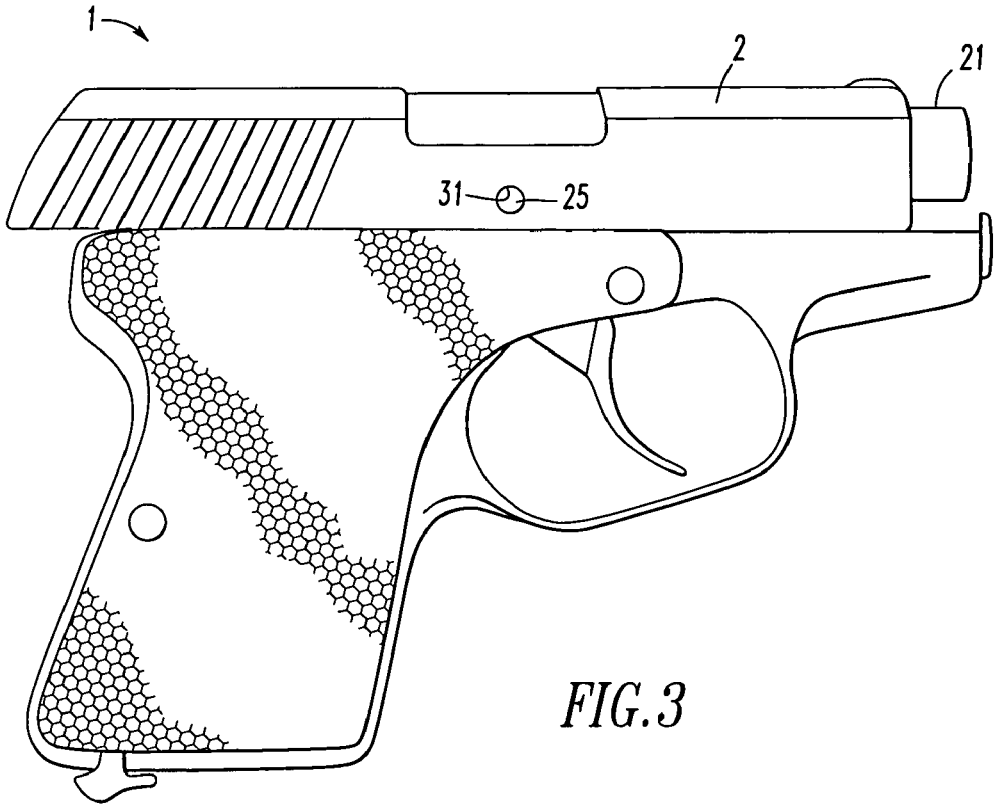
FIG. 3 is a reverse side view of a handgun of the Rohrbaugh design with the slide pulled back.

As shown in FIG. 2, rearward movement of the slide 2 exposes a barrel 21 and recoil assembly 22, and more particularly the barrel front face 23 and guide rod front face 24. FIG. 2 shows the slide 2 in a take-down position at which a barrel pin 25 is exposed through a drift hole 26 of the slide 2. The drift hole 26 is large enough for the barrel pin 25 to pass therethrough. FIG. 3 shows a reverse side of the handgun 1. The slide 2 includes an ejector side hole 31 that is smaller than the barrel pin 25. The ejector side hole 31 prevents the barrel pin 25 from passing therethrough.

Retaining the slide 2 in the take-down position during disassembly is difficult because the recoil assembly in the slide assembly is spring loaded. Traditional handgun designs include levers or latches that lock the slide in the required position or easily manipulated external barrel pins. The Rohrbaugh design lacks external barrel pins or levers. One hand must hold the slide in position while the other ejects the barrel pin 25. More difficult is holding the slide 2 during assembly because the slide 2 must be held in the take-down position while the barrel pin 25 is engaged. Unfortunately, such manual dexterity can be problematic.

Figure 4:
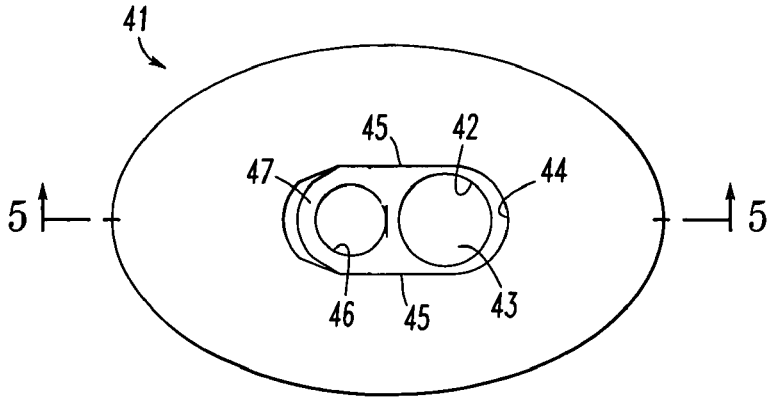
FIG. 4 is a top view of a device of the present invention.
Figure 5:
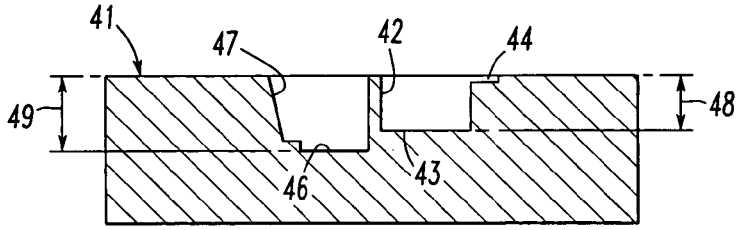
FIG. 5 is a cross-sectional side view of the present invention.

FIGS. 4 and 5 show a device 41 of the current invention. Unless otherwise distinguished, "front face" refers to the front face of the slide, guide rod or frame, and "body" means either the slide, guide rod or frame. The device 41 includes a first indentation 42 having a first depth 48 and, optionally, a bottom 43. The first indentation 42 is adapted to receive a first front face. A first ridge 44 at least partially surrounding the first indentation 42 prevents the body from entering the first indentation 42. The first ridge 44 and the depth of the first indentation 42 fix the elevation of the body relative to the front face.

For convenience, the device may include a recessed perimeter 45 that approximates the dimensions of the body. Optionally, a second indentation 46 having a second depth 49 is adapted to receive a second front face. For example, if the first indentation receives the barrel's front face 23, the second indentation 46 will receive the guide rod front face 24. The second indentation permits the operator to hold more securely the handgun 1 in position while the barrel pin 25 is removed or inserted. The device may even include a recessed surface 47 that conforms to the frame. The surface conforms to the body to ease alignment. In one aspect of the device as used with the Rohrbaugh design, the surface may be slanted, such as a bevel.

The depths of the indentations are chosen so that the barrel pin is visible through the drift hole and ejector side hole. Pushing the handgun in the device moves the slide rearward so that the barrel pin is exposed. Naturally, the depths and ridges must be chosen for the particular handgun. Preferably, the depths of the indentations are chosen so that the barrel pin can be removed or inserted without undue force, that is, in a tension-free state.

Figure 6:
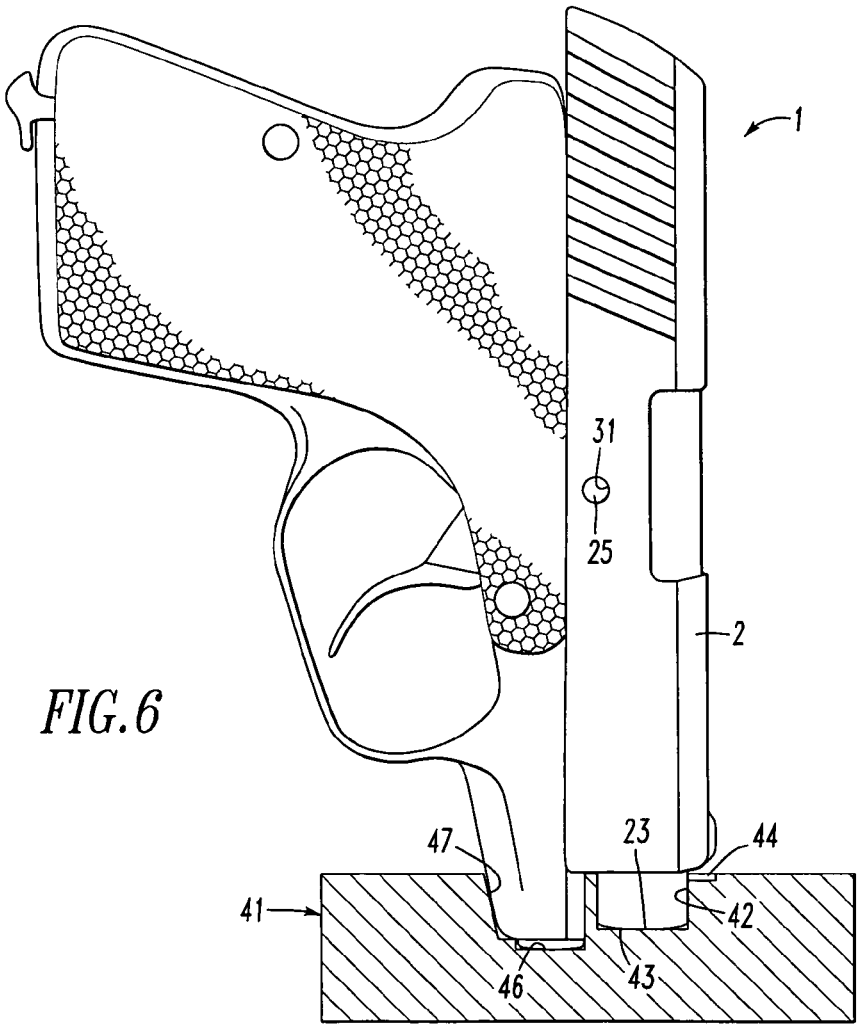
FIG. 6 is a reverse side view of a Rohrbaugh design handgun in use with a device of the present invention.

FIG. 6 shows a handgun 1 in one embodiment of the device 41. The device includes a first indentation 42 and a second indentation 46. The handgun 1 is pushed into the first indentation 42 with sufficient force so that the barrel front face 23 contacts the bottom 43 of the first indentation 42. Simultaneously, the guide rod face is pushed flush with the second indentation 46. The first ridge 44 pushes the slide 2 rearward. The depth of the first indentation 42 relative to the first ridge 44 corresponds to the distance the slide 2 must move rearward to expose the barrel pin 25 through the ejector side hole 31 and drift hole (not shown). In this embodiment, the depth of the second indentation 46 relative to the second ridge 47 also corresponds to the distance the slide 2 must move rearward to expose the holes. Optionally, the frame rests on a recessed surface 48.

A pin removal tool (not shown) may be inserted into the ejector side hole 31 thereby pushing the barrel pin 25 through the drift hole. The pin removal tool may include a portion that permits easy manipulation of the pin removal tool. Portions include simple geometric or ergonomic shapes that are conveniently grasped by a single hand.

The device may be of any suitable material but preferably comprises a non-abrasive material so as not to scratch the handgun. The material should be easily moldable, castable or carvable and will comprise a material that resists breakage. Conveniently, the device may comprise a clay-containing compound or a polymeric material, such as, for example, polyolefins, vinyls, silicones, acrylics, polycarbonates, natural and synthetic rubbers, and their copolymers. Thermoplastic polymeric materials are especially convenient, in that they are inexpensive and easy to manufacture, for example, by injection molding or pressing. Suitable materials include.

Obviously, numerous modifications and variations of the present invention are possible. It is, therefore, to be understood that within the scope of the following claims, the invention may be practiced otherwise than as specifically described.

What is claimed is:

1. A handgun and disassembly device for use with a handgun having a barrel pin securing a slide to a body of the handgun, the disassembly device comprising:

a first indentation having a depth for receiving a front face of the handgun, a first ridge at least partially surrounding the first indentation for receiving the body, the depth and ridge spaced so that the barrel pin aligns with a drift hole of the slide when the handgun is pushed into the device.

2. The handgun disassembly device of claim 1, wherein the first indentation terminates in a bottom.

3. The handgun disassembly device of claim 1, wherein the device defines a second indentation adapted to receive a second front face of the handgun, a second ridge at least partially surrounding the second indentation adapted to receive the body of the handgun, thereby steadying the handgun in the device.

4. The handgun disassembly device of claim 3, wherein at least one indentation conforms to the body of the handgun.

5. The handgun disassembly device of claim 4, wherein at least one indention comprises a beveled surface.

6. The handgun disassembly device of claim 1, wherein the device comprises a moldable material.

7. The handgun disassembly device of claim 1, wherein the device comprises a material selected from the group consisting of clay and a polymer.

8. The handgun disassembly device of claim 7, wherein the polymer comprises a thermoplastic polymer.

9. The handgun disassembly device of claim 8, wherein the thermoplastic polymer is selected from a group consisting of polyolefins, vinyls, silicones, acrylics, polycarbonates, natural rubbers, synthetic rubbers, and their copolymers.

10. A handgun and disassembly device for use with a handgun having a barrel pin securing a slide and a barrel to a gun frame, the disassembly device comprising an indentation having a bottom, a ridge at least partially surrounding the indentation, the bottom and ridge separated by an elevation difference sufficient to expose the barrel pin through a drift hole in the slide when the barrel is pushed to the bottom of the indentation and the frame contacts the ridge.

11. The handgun disassembly device of claim 9, wherein the device defines a second indentation adapted to receive a second front face of the handgun, thereby steadying the handgun in the device.

12. The handgun disassembly device of claim 11, wherein a second ridge at least partially surrounds the second indentation and the second ridge conforms to the frame of the handgun.

13. A handgun and disassembly device for use with a handgun having a barrel pin securing a slide and a barrel to a body of the handgun, the disassembly device comprising an indentation having a depth, a ridge at least partially surrounding the indentation, a distance between the depth of the first indentation and the ridge, the distance sufficient to expose the barrel pin when the barrel is pushed into the indentation and the body contacts the ridge.

* * * * *